US006003735A

United States Patent [19]

Strecker

[11] Patent Number: 6,003,735

[45] Date of Patent: Dec. 21, 1999

[54] HAND-PORTABLE SAFETY-CANISTER W/VARI-FLOW THUMB-VALVE

[76] Inventor: Dean A. Strecker, 8695 Ara Pl., San Diego, Calif. 92126

[21] Appl. No.: 08/935,556

[22] Filed: Sep. 22, 1997

[51] Int. Cl.[6] ..... B67B 5/00

[52] U.S. Cl. ..... 222/153.14; 222/470; 251/99

[58] Field of Search ..... 222/470, 472, 222/529, 153.14; 251/99, 289

[56] References Cited

U.S. PATENT DOCUMENTS

| | | | |
|---|---|---|---|
| 604,386 | 5/1898 | Goodwin | 222/472 |
| 1,381,873 | 6/1921 | Hardy | 251/304 X |
| 2,547,847 | 4/1951 | Barclay | 222/484 |
| 2,670,107 | 2/1954 | Welden | 222/474 |
| 3,469,747 | 9/1969 | Richmond | 222/469 |
| 3,727,807 | 4/1973 | Flider | 222/4 |
| 3,746,200 | 7/1973 | Flider | 222/466 |
| 3,858,843 | 1/1975 | Hartmann | 251/99 |
| 3,927,797 | 12/1975 | Flider | 220/55.7 |
| 4,063,667 | 12/1977 | Flider | 222/470 |
| 4,645,099 | 2/1987 | Gillispie et al. | 222/472 |
| 4,834,270 | 5/1989 | Messner | 222/484 |
| 5,564,608 | 10/1996 | Cooper | 222/470 |

OTHER PUBLICATIONS

PTO/Disclosure Document Program: . . . #409,903, filed: Jan. 07, 1997.

*Primary Examiner*—Gregory L. Huson

[57] ABSTRACT

A much safer, and more convenient to use, flammable-liquid storage-container of the hand-portable 1–5 gallon blow-molded/polyethylene-plastic type; featuring a special direct thumb-actuated ballvalve, with geneeric-variations, configured to enable single-handed holding and dispensing without hazardous spillage. Designed to be safely carried within a car's trunk, the removable fill-cap is equipped with a child-resistant/tipover-safe safety-lockout device disengaging the thumb-control from positive engagement with the ball-valve in the closed position. The user must first grasp and uphold the "SafeTflow"™ container in hand via the upper longitudinal handle-grip, while positioning their thumb forward upon a leverarm actuator arranged upon a pivot-shaft extending up and aftward from the ballvalve rotary-axis. The user must first be of the mind to intentionally exert certain dexterity as to at once depress the spring-loaded swivel-leverarm with their thumb, thereby engaging the swivel-leverarm with a spline on the ballvalve's pivot-shaft. Otherwise the swivel-leverarm merely rotates continuously without opening the ballvalve. Included is an optional quick-disconnect dispensing-nozzle of clear-plastic, which can be readily stowed within the container just beneath the ballvalve cap; which preserves compactness of the apparatus, while enabling spill-free dispensing when externally attached.

20 Claims, 1 Drawing Sheet

Fig.-1
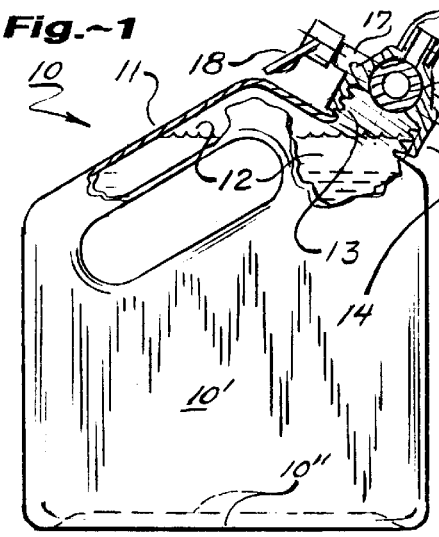
Fig.-2
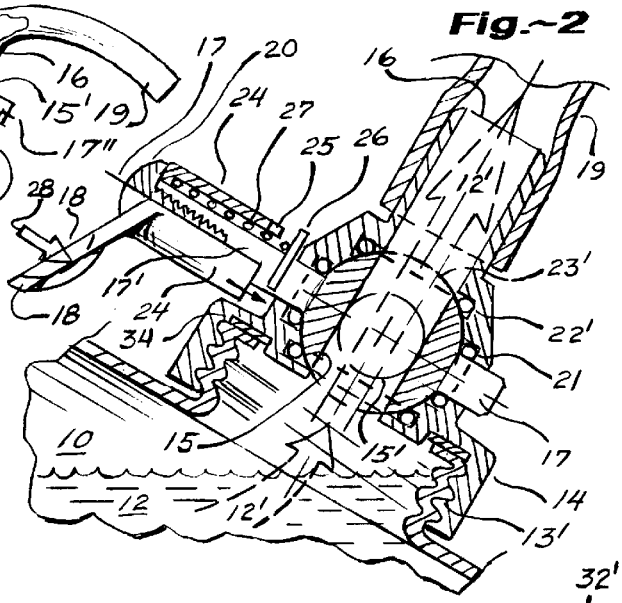
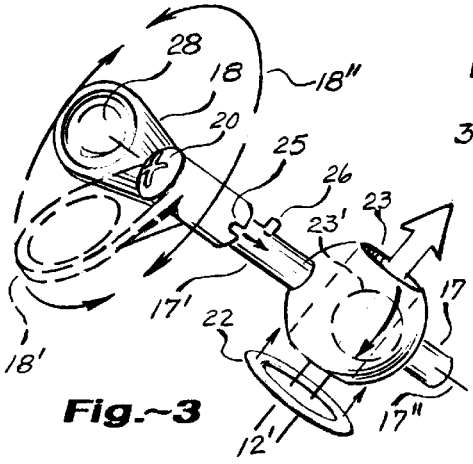
Fig.-3
Fig.-4
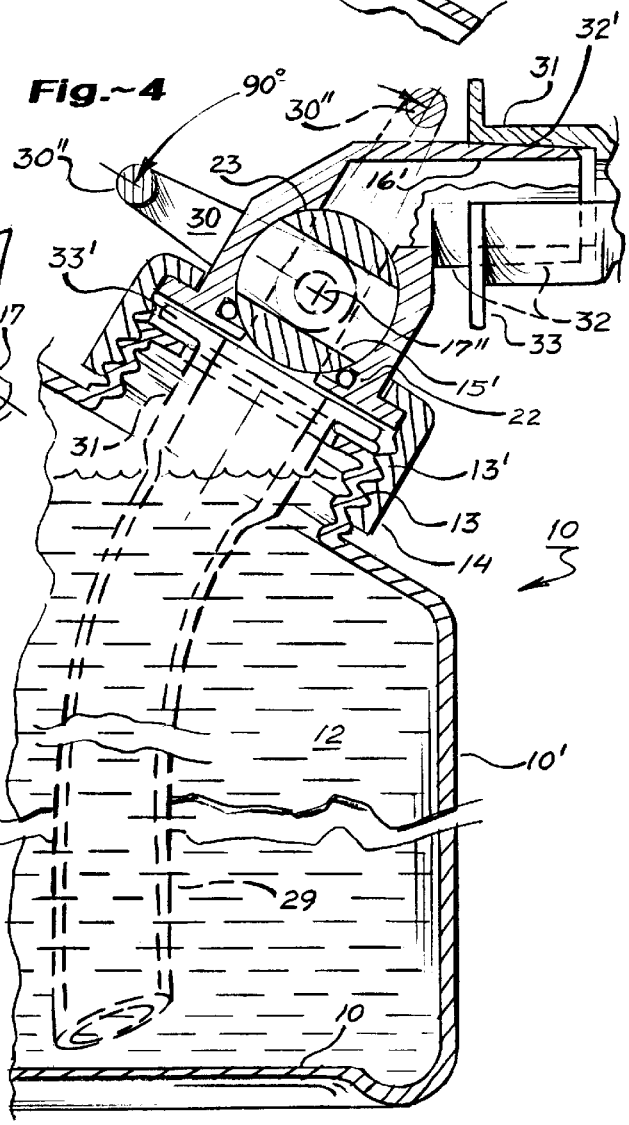
Fig.-5
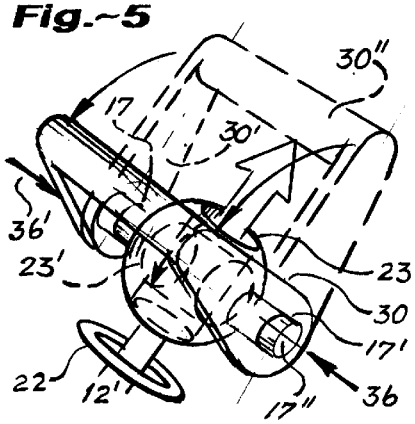

HAND-PORTABLE SAFETY-CANISTER W/ VARI-FLOW THUMB-VALVE

I.) BACKGROUND OF RELEVANT EARLIER INVENTIONS

1. Field of Invention

This invention relates to hand-portable containers suitable for flammable (otherwise referred to in the English idiom as "inflammable") liquids, and particularly it relates to safety and convenience related canisters having valved spigots thereof.

2. Related Prior-art

Background research discovery provides some prior patent-art for hand-portable safety-canisters regarded as germane to this disclosure. Chronologically for example, U.S. Pat. No. 2,607,107 (filed: April 1948) shows a teapot with handle having an index-finger operated trigger which actuates a spring-loaded flip-open stopper-cap. However, by way of example, the stopper-cap is not child-resistant, nor leak-proof; and is therefore unsuitably dangerous for any flammable-liquid, especially if carried in the trunk of an automobile.

In U.S. Pat. No. 2,547,847(filed: May 1946) is shown a flammable-liquid canister having a flexible-metal spout and handle, including a two-finger operated trigger serving to open a spring-loaded flip-open stopper-cap. Again, by way of example, such flip-open type stopper-caps are not child-resistant nor leak-proof, and prove very dangerous if carried in an automobile trunk.

In U.S. Pat. No. 2,815,892(filed: August 1953) is shown a safety-dispenser for flammable-liquids, having a horizontally-swiveling pour-spout which rotates 180-degrees to stow into a recess of the carry-handle. The pour-spout includes a special screw-on stopper, which lacks user convenience, and is prone to becoming lost. An air/relief-valve is also provided to improve pouring-rate.

In U.S. Pat. No. 3,469,747(filed: September 1967) is shown a flammable-liquid canister having a combination carry-handle, and flip-open cap; which arrangement unfortunately makes the convenience of single handed pouring impossible.

In U.S. Pat. No. 3,727,807(filed: December 1970) is shown a flammable-liquid canister featuring a special combination carry-handle which acts to simultaneously open both the pour-spout (flexible-metal) poppet-valve and an oppositely situated air/relief-valve. However, the so-called safety-can is very prone to leakage if tipped-over.

In U.S. Pat. No. 3,746,200(filed: August 1971) is shown a blow-molded plastic so-called "Jerry-can", wherein a portion of the carry-handle is integrally-formed and is employed to exert a spring-like bias of the flip-open stopper-valve toward the closed position. however, the operation is not child-resistant nor is it leak-proof during accidental tip-over.

In U.S. Pat. No. 3,927,797(filed: January 1974) is shown another Jerry-can of blow-molded plastic, hear featuring a two-finger operated stopper-cap of the now familiar flip-open type, which although somewhat better human-engineered for pouring convenience and balance (but states that two hands are required to carefully control pouring), still is not child-resistant and will leak if accidentally tipper-over.

In U.S. Pat. No. 3,858,843(filed: April 1974) is shown a ballvalve employing a locking lever-arm preventing unintended opening of the valve-ball; and includes a compression-spring arranged coaxial upon the valve's pivot-axis so as to enable the lever-arm to be rocked back out of impingement upon an abutment-lug blocking rotation of the valve. However, since the lever-arm is nevertheless still positively engaged with the valve's pivot-shaft, there remains some possibility that the valve could be inadvertently opened, especially if the compression-spring were to malfunction.

In U.S. Pat. No. 4,063,667(filed: December 1975) is shown another plastic canister for flammable-liquids, which sets forth a rather complex and awkward arrangement of poppet-valve to control pour-rate and a flip-open air/relief-valve to improve pour-rate. However, the configuration is not child-resistant nor is it leak-proof in the event of accidental tip-over.

In U.S. Pat. No. 4,834,270(filed: April 1988) is shown another plastic flammable-liquid canister having an integrally-formed carry-handle, a screw-on fill-cap, and a thumb operated poppet-valve which is pushed-open during pouring while an air/relief-valve is also opened. However again, the design is not child-resistant nor particularly leak-proof during event of accidental tip-over.

In U.S. Pat. No. D 305,982(filed: October 1987) is shown a design of a blow-molded plastic flammable-liquid canister, which is not child-resistant to dangerous tampering; although it's tip-over resistance to leakage may be satisfactory, owing that both the pour/fill-cap and air/relief-cap are of the screw-threaded type which may be furnished with suitable sealing-gasgets.

In U.S. Pat. No. D 338,158(filed: May 1991) is shown a design for a blow-molded plastic flammable-liquid canister, which is substantially like the previous design except as to minor styling differences.

In U.S. Pat. No. D 358,330(filed: May 1994) is shown a design for another blow-molded plastic flammable-liquid canister, being quite similar to the previous example except that it features two handles, one for the normal carry mode of use, the alternate handle serving as a more convenient pour-handle mode of use.

In U.S. Pat. No. D 356,951(filed: April 1992) is shown another design for a blow-molded plastic flammable-liquid canister, this one also featuring dual-mode carry/pour-handles being substantially like previous designs except as to minor styling differences.

In U.S. Pat. No. 5,406,994(filed: August 1994) is shown the utility-patent of the previous canister design, wherein is provided a special pour-spout which works in combination with a viewing-window provided in the sidewall of the canister, thereby enabling the user to visually determine just when the receiving container is full and liquid flow has ceased.

In U.S. Pat. No. 5,449,088(filed: August 1994) is shown the utility-patent of the Jerry-can type, wherein is provided a special sidewall elongate viewing-window, enabling the user to visually determine the amount of liquid contained therein.

In U.S. Pat. No. D 372,871(filed: March 1995) is shown another design for a blow-molded plastic flammable-liquid canister, this one also featuring dual-mode carry/pour-handles being substantially like previous designs except as to minor styling differences.

In U.S. Pat. No. 5,564,608(filed: May 1995) is shown a so-called safety type heavy-duty hand-portable flammable-liquid metal type canister, of cylindrical shape and including an upwardly extending sidewall portion enabling the carry-handle and spigot-valve control-handle and air/relief-valve to all be thereby protectively enshrouded within the sidewall surround. The threaded metal-flexpipe is screwed to the poppet-valve body through a port in the sidewall, enabling the removable flexpipe to be stowed within the shrouded cavity region. However, study of the finger-pulled valve-trigger and poppet-valve design reveals the arrangement to not be child-resistant, nor is the valving made positively leak-proof in event of tipover.

Therefore, in full consideration of the preceding patent review, there is determined a serious need for an improved form of device to which these patents have been largely addressed. The instant inventor hereof believes their newly improved flamable-liquid dispenser device, commercially referred to as the SafeTflow™, currently being developed for production under auspices of the Strecker-Mfg./Mkt.Co., exhibits certain advantages as shall be clearly revealed in the ensuing portion of this instant disclosure.

II.) SUMMARY OF THE INVENTION

A.) in view of the foregoing discussion about the earlier invention art, it is therefore important to make it pellucid to others interested in the art that the object of this invention is to provide a positively sealing safety-valve of a type never before contemplated for employment in a safety-canister apparatus. It is herein now considered critical that such a valve be very child-resistant;—that is, at least for children under about eight-years, known prone to ignorantly tamper with containers (as may be holding flammable-liquids such as gasoline or laquer-thinner) often found in the home-garage for example. Still another critical criteria of safety for flammable-liquid canisters, is that they have a natural positive resistance to spillage or even slight leakage, as may be caused by falling from a workbench, or tipover in a vehicle trunk (which can hold volatile-fumes as a potential bomb), or upon accidental impact from another object.

Although well known among valving engineers, the ball-valve (preferably of spherical configuration) is employed most commonly in kitchen and lavatory sink-faucet valving, especially of the single combined-hot/cold tilt-unilever control type (popularly produced by the Delta-Faucet Corp.). However, for adaptation herein, it is preferred that to make the valve device even more resistant to accidental opening, the tilt-action be negated in favor of a pure rotational-action, not prone to actuation by cause of sudden impact for example. The vital safety notion thus being, to provide a flow-hole orifice in the ballvalve's valve-ball which is rotatably aligned with adjoining in/out through apertures during the open-modality of operation; while upon rotation upon it's pivot-axis biases the flow through-hole in the ballvalve to be missaligned, thereby positively (hence safely) occluding any slight flow therethrough; in as much as the ballvalve is not dependent upon spring-tension for closure in the typical manner of a poppet-valve for example.

B.) Another object of this invention disclosure is to set forth a flammable-liquid canister preferably of the one-piece blow-molded type (generally of polyethylene-plastic resin) article having an aperture which preferably serves as a combination inlet(aperture through which the canister is to be filled) and outlet(from which the liquid is to be dispensed), and to which is provided a detatchable pour-spout preferably including a section (about 6–10 inches) of transparent flexile plastic tubing (generally of PVC-plastic). A ballvalve is preferably adapted to the inlet/outlet-aperture via screw-threads ("screw-threads" may be of conventional or quick-release bayonet-type design). The ballvalve preferably operates rotationally via a variable flow-control lever-arm arranged coaxially relative to the ballvalve's pivot-shaft axis. To make the ballvalve as safe as possible around youngsters not yet old enough to truly comprehend the danger of flammable-liquids, a child-resistant impediment to operating the bellcrank is devised. The flow-control bellcrank is preferably made to merely swivel freely upon the pivot-axis, until properly actuated by the capable dexterity of an older person, who can manfage to simultaneously depress the leverarm sufficiently along the pivot-axis as to positively engage with some manner of indexing spline provided upon the pivot-shaft of the ballvalve's pivot-axis.

An alternate safety arrangement is provided by a flexile sear-detenter device which must be manually deflected from it's safety detented condition in order to swivelly bias the ballvalve's leverarm toward open position. In this iteration it is preferred that the ballvalve's pivot-axis be provided with a built-in return-spring, whereby upon manual release of the flow-control leverarm apparatus the ballvalve automatically returns to it's normally-closed condition.

In either embodiment, it is preferred that the leverarm member include a concave swivel-depression formation therein, whereby the user's finger-tip or thumb-tip may be manually pressed thereupon while exerting a swiveling-action as to thereby precisely bias the ballvalve toward it's open position.

C.) Another object of this invention disclosure is to set forth a flammable-liquid canister type article wherein there is established a critical combination arrangement by which the preferably integrally formed carrying and pouring handle (preferably forming a part of the internal-volume of the canister) and the proximal flow-control ballvalve and cooperative leverarm facilitate simultaneous single-handed lifting and finger-tip variable pouring therefrom. The flow-control action may be either of a direct swiveling manipulation of the leverarm, or an optional arrangement may be employed whereby semi-linear fore/aft articulation action of a leverarm acting upon a very differently oriented pivot-shaft is optionally preferred. This alternate leverarm arrangement is preferably of a double-arm configuration, comprising a right-side leverarm and a left-side leverarm, both extending at a right-angle from a common transversely horizontal pivot-shaft, thereby enabling a generally 90-degree fore/aft longitudinal tilting-action manner of operation.

In either example of ballvalve articulation, it is necessary that the leverarm be either positively detained via: 1.) a detent catch arrangement, with the valve-ball in closed position, or: 2.) the leverarm rendered to swivel free of positive engagement upon the ballvalve's pivot-shaft, in either case until certain dexterity is manually exerted to at once depress the springably detained safety-lockout;—the user thereby exhorting pressure to override(release) the safety-lockout and move the leverarm toward the ballvalve's open position.

III.) BRIEF DESCRIPTION OF THE DRAWINGS

The foregoing and still other objects of this invention will become fully apparent, along with various advantages and features of novelty residing in the present embodiments, from study of the following description of the variant generic species embodiments and study of the ensuing description of these embodiments. Wherein indicia of reference are shown to match related matter stated in the text, as well as the claims section annexed hereto; and accordingly, a better understanding of the invention and the variant uses is intended, by reference to the drawings, which are considered as primarily exemplary and not to be therefore construed as restrictive in nature; wherein:

FIG. 1, is a side/elevation-view showing the overall invention, whiich is partially cut-away in both the handle and control-valve regions;

FIG. 2, is a 5×-enlargement thereof showing details of the preferred embodiment for a swivel-controled ballvalve which pivot-shaft rotates on an obliquely longitudinal fixed-position axis bisecting the valve's flow-path;

FIG. 3, is an upper pictorial view showing a diagrammatic view of the ballvalve swiveling type functional members without the pour-spout housing member thereof;

FIG. 4, is a partial side/elevation-view in the same scale and portion according to FIG. 2, wherein is revealed an alternate tilt-controlled generic-variant, which pivot-shaft is arranged on a horizontally transverse axis bisecting the valve's flow-path;

FIG. 5, is an upper pictorial view showing a diagrammatic view of the ballvalve tilting type functional members without the pour-spout housing member thereof.

V.) DETAILED DESCRIPTION OF THE PREFERRED EMBODIMENTS

Initial reference is given by way of FIG. 1, wherein is exhibited the presently most preferred embodiment for the overall safety canister 10, having sidewalls 10' and bottom-wall 10"; and wherein a portion of the preferred convenient 60-degree inclined carry-handle 11 is shown cutaway, as to better reveal how the generally flammable-liquid 12 is able to efficiently occupy the carry-handle's preferably hollow passageway (fairly typically handle construction for blow-molded polyethylene-plastic gasoline containers). Note however the critically human-engineered close relationship between the handle 11 and thumb-lever 18, which is conveniently reach accessible by the user's thumb, which can be readily laid to rest into the dimple like concave thumb-depression 28 clearly shown in FIG. 3.

The vital notion of safety being particularly addressed in this invention disclosure is brought forth in FIG. 2, wherein it is also shown that the thumb-lever 18 is designed to freely swivel about the long pivot-shank 17' extending from central valve-ball 23. Intended to safely confound hazardous operation by youngsters or others considered incompetent to handle potentially dangerous liquids. The freely continuously swiveling thumb-lever must be firmly urged inward on pivot-shaft 17' toward index-lug 26 (which may be a metal-pin pressed into the pivot-shaft) until the swivel-sleeve's index-notch 25 reaches positive engagement with index-pin 26, whereupon the user must necessarily exert sufficient dexterity as to positively rotate the valve-ball 23 90-degrees into fully open position. Naturally, numerous iterations of this device function can be designed, including arrangements involving indexing splines, indexing flats on otherwise round male into female pivot-shaft members, and the like;—however, any such configuration intended to provide free swiveling (or free wheeling action) in the first-position, and positive engagement in the second-position, is to be considered tantamount to serving the purpose of confounding hazardous operation:—yet enabling quick and easy operation by a person competent to handle dangerous flammable-liquid (such as gasoline or laquer-thinner for example).

There remain subtle, however vital other different features which are to become herein more evident and understood as important improvements. For example, FIG. 2 also shows how the spherical valve-ball 23 shown closed in FIG. 1 facilitates a voluminous flow 12' of liquid 12 from the container screwcap pour-spout 16 (here shown with untapered outer-diameter), preferably including an approximate 8–10 inch length of transparent vinyl-plastic flexile tubing (flex hose) 19, which is handy for carefully observing liquid-flow while filling a lawnmower's small gastank for example. However, the primary advantage of my ballvalve adaptation resides in it's superior liquid-retention ability in closed-position 23' (FIGS. 2&3) in event of an accidental tipover situation. Note in FIGS. 3&5 particularly, that preferred neoprene O-ring 22 inpinges directly against the lower hemisphere of the valve-ball's through-hole 15 region, and when the valve-ball is closed 23' as depicted in FIGS. 1&4, the resultant hermetic-seal holds liquid 12 therein even if canister 10 were subjected to a heavy weight borne thereupon;—the liquid retention ability generally exceeding the burst-strength of the canister's screw-cap 14. By way of comparison, the conventional flat elastomeric-washer 28 therefore being a more probable point of potential leakage (which is unlikly provided screwcap 14 is tightly installed upon screw-threads 13 of the cansiter's inlet/outlet 35). Heretofore, the nature of State Fire-marshall certified gasoline-canisters for example, has been to either incorporate screw-on caps only, or to permit dangerous employment of vapor & leakage prone trigger-operated poppet-valves;—simply because until now there has been nothing safer available! The other O-ring seals, namely right & left pivot-shaft seals 21, and outer valve-ball backup(redundant) seal 22', are included here as good engineering practice, yet are not of the vitally critical nature as lowermost internally wetted O-ring (or variants thereof) seal 22.

In FIG. 2 I show a slip-on section of transparent flexile plastic-tubing 19 manually pressed upon the integrally-molded male pour-spout 16, thereby enabling the careful user to visually monitor the liquid flow-rate, as is also shown in FIG. 1. However, the most preferred flow-nozzle embodiment is shown in FIG. 4, which depicts how the low-cost expedient of a slightly tapered (about 7-degrees of taper) pour-spout 16' includes a tapered-O.D.(outside-diameter) 32 cooperating with a separate manually pressed-on female-fitting 31 having a generally like matched taper 32', creating a fluid-tight connection,—until manually urged apart as shall be explained. For an optimally snug male/female retention mating, the taper of the plastic female-fitting can be made slightly less than 7-degreees (about 6½-degrees taper), so as to take advantage of tendancy for the female-fitting 31 to bellmouth slightly against mating male pour-spout 16'.

Also shown in FIG. 4 is a generic-variant ballvalve embodiment, here having it's pivot-axis 17" arranged horizontally transverse to the longitudinal plane of carry-handle 11 (FIG. 1), instead FIG. 2's obliquely longitudinal orientation of the pivot-axis 17". While considered vital to this invention that some such form of safety-lockout be provided, the mechanism by which this be achieved can naturally take on different mechanical arrangements. For example, in FIG. 2 the thumb-lever (leverarm) 18 is free to swivel 360-degrees (continuous) via return-spring 27 (always preload compressed) which acts to keep the swivle-sleeve 24 indexer-notch 25 from normally engaging positively with the index-lug 26. When the canister user wishes to bias the ballvalve open to dispense 12' it's liquid contents, the user can lift, actuate, and pour,—all with a single hand. The user having to merely hold the canister's carry-handle 11 while placing their thumb upon thumb-depression 28, and push 35(ref.arrow) the thumb-leverarm 18 toward the internally housed valve-ball 23 until the indexer-notch 25 positively engages upon the index-lug 26,—whereupon the user swivels their thumb around 90-degrees to fully open the valve-ball's through-hole 15 as shown in FIG. 2. In contrast, although essentially still biasing the valve-ball 90-degrees between it's closed-position 23' and open-position 23, in FIG. 5 it is done at a right-angle to that rotational-axis 17" shown in FIGS. 2,3. While the swivel tilting (swiveling extent limited by ultimate structural interference in both fore/aft movement) of coacting left & right leverarms 30 are somewhat tantamount to leverarm 18 (FIG. 2), it is preferred that the U-shaped bail leverarms 30 (FIG. 5) be integrally-molded with a transverse crossover bail-bar portion 30", which is pivotally-fixed at the right, yet able to be springably biased inward (toward the valve-ball 23) by virtue of their inherent flexural quality (obviating need of a compression return-spring) of the U-shaped bail leverarm 35. Hence, during single-handed operation, the user would be obliged to exert certain dexterity, by holding canister handle 11 in the last three fingers of their right-hand. while manually pressing laterally inward 36 against the base region of one of the leverarms 30 (to similarly engage an indexer-notch 25' with pivot-shaft index-lug 26' per FIG. 3). and then employing their remaining index-finger to bias the entire U-shaped (bail) leverarm 35 aftward 90-degrees in the manner of FIG. 4. Although a more conveniently human-engineered version of the FIGS. 4&5 embodiment is under development, suffice to say, the essential safety-lockout concept being set forth herein shall prevail in any case.

When the user intends to store the canister away in their car's trunk or in the garage storage-cabinet, it has been found that removing the optional flow-nozzle 29 in quick-disconnect fashion for internal stowing according to FIG. 4, making the canister much more easily stowed upon a shelf for example. By manually pulling outward on the annular-flange 33 (while slightly twisting the female-fitting portion 31 slightly), the entire extension flow-nozzle 29 readily detaches from the male pour-spout 16';—whereupon the user unscrews the ballvalve's screw-cap 14 as to insert the flow-nozzle assembly invertedly down into the canister's inlet/outlet aperture 36, resecuring ballvalve/screw-cap 14;—finding canister 10 therefore more easily stowed while protecting the nozzle 29 from dust and dirt accumulation.

Thus, it is readily understood how the preferred and generic-variant embodiments of this invention contemplate performing functions in a novel way not heretofore available nor realized. It is implicit that the utility of the foregoing adaptations of this invention are not necessarily dependent upon any prevailing invention patent; and, while the present invention has been well described hereinbefore by way of certain illustrated embodiments, it is to be expected that various changes, alterations, rearrangements, and obvious modifications may be resorted to by those skilled in the art to which it relates, without substantially departing from the implied spirit and scope of the instant invention. Therefore, the invention has been disclosed herein by way of example, and not as imposed limitation, while the appended claims set out the scope of the invention sought, and are to be construed as broadly as the terminology therein employed permits, reckoning that the invention verily comprehends every use of which it is susceptible. Accordingly, the embodiments of the invention in which an exclusive property or proprietary privilege is claimed, are defined as follows.

What is claimed of proprietary inventive origin is:

1. A flammable-liquid safety-canister apparatus providing convenient ergonomic hand-operation; said apparatus comprising:

an imperforate container, including a handle portion, plus inlet and outlet portions;

a pour-spout thereto having a ballvalve providing positively occludeable and selectively variable flow-control with a free-wheeling safety-lockout means;

a critical combination arrangement means by which said handle is juxtaposed proximal said flow-control ball-valve to facilitate simultaneous single-handed lifting and finger-tip variable pouring therefrom.

2. The safety-canister apparatus according to claim 1, wherein said flow-control means is an indexable leverarm arranged upon pivot-axis of said ballvalve, said pivot-axis arranged perpendicular to the flow-path of said outlet aperture, whilst said safety-lockout enables said leverarm to swivel free-wheelingly from positive engagement with said pivot-axis pivot-shaft until said leverarm is manually urged into positive engagement with a mating indexer device upon said pivot-shaft, but returning to free-wheeling relationship when not so urged.

3. The safety-canister apparatus according to claim 1, wherein said flow-control means is via a leverarm like device extending from the pivot-shaft of said ball-valve member, said leverarm including a thumb-swivel formation thereto, whereby user's finger-tip or thumb-tip may be pressed thereupon while exerting a swiveling-action as to thereby precisely bias said ball-valve portion toward open or closed position.

4. The safety-canister apparatus according to claim 1, wherein said selectively variable flow-control means is operated via the user's finger-tip or thumb-tip manipulation biasing of a leverarm like member extending from a pivot-shaft arranged upon the pivot-axis of said valve-ball.

5. The safety-canister apparatus according to claim 1, wherein said flow-control means is a leverarm arranged upon the pivot-axis of said ball-valve member, and whereby said critical proximal arrangement of said leverarm relative to said handle enables user to variably manipulate said leverarm via finger-tip or thumb-tip dexterity precisely as desired.

6. The safety-canister apparatus according to claim 1, wherein said selectively variable flow-control means is automatically shut-off by a return-spring upon release of operator's finger-tip or thumb-tip pressure acting to bias said ball-valve toward the open position.

7. The safety-canister apparatus according to claim 1, wherein said inlet aperture is a conventional air-bleed vent formed as a separate opening from said outlet aperture, and includes screw-threads facilitating attachment of a screw-cap by which to be manually removed for relief of ambient airpressure-differential surging during pouring.

8. The safety-canister apparatus according to claim 1, wherein said ball-valve is adapted to within said pour-spout portion, and includes a male-spout like outward extension portion capable of receiving a section of slip-over hose.

9. The safety-canister apparatus according to claim 1, wherein said slip-over hose is made of transparent flexile plastic-tubing, enabling user to visually monitor the flow-rate of liquid pouring from said canister.

10. The safety-canister apparatus according to claim 1, wherein said leverarm safety-lockout means is an indexer device whereby said leverarm is detained fully in said closed position until a flexile-catch is deflected from it's safety detented condition.

11. The safety-canister apparatus according to claim 1, wherein said flow-control means is a leverarm arranged upon the pivot-shaft of said valve-ball, said pivot-shaft arranged transversely horizontally to said canister handle's longitudinal plane, thereby facilitating an aftward movement of said leverarm to open said ballvalve.

12. The safety-canister apparatus according to claim 1, wherein said ballvalve is arranged within said pour-spout cap portion which is screw-threadedly adapted to said canister outlet and includes a short male-spout like outward extension portion capable of receiving a quick-disconnect female-fitting having a nozzle portion, said female-fitting including an annular-flange portion whereby said female-fitting can be removed and inverted 180-degrees for compactly stowing said nozzle portion within said canister confines by unscrewing said pour-spout and reversing the annular-flange of said male-spout between said outlet aperture and said pour-spout cap member.

13. The safety-canister apparatus according to claim 12, wherein said quick-release means is provided by a matched slightly tapered fitting joint arranged between said male-spout and said female-fitting; thereby enabling said male-spout and female-fitting to be manually pressed intimately together, creating a fluid-tight connection until manually urged apart.

14. The safety-canister apparatus according to claim 1, wherein said canister is made in one-piece of blow-molded polyethylene-plastic, and said handle is integrally formed as a part of the internal-volume of said container.

15. The safety-canister apparatus according to claim 1, wherein said ballvalve includes a male-spout like outward extension portion capable of receiving a section of slip-over hose made of transparent flexile plastic-tubing, thereby enabling user to visually monitor the flow-rate of liquid pouring from said canister.

16. A child-resistant tipover-safe flammable-liquid safety-canister apparatus providing convenient ergonomic hand-portable operation; said apparatus comprising:

an imperforate container unit, including a handle portion and at least one inlet and outlet aperture portion;

a pour-spout with a cap having detatchable means of securing to said outlet aperture, including a ballvalve therein with a valve-ball having an occludeable through-hole and selectively variable flow-control means adapted thereto in form of a leverarm arranged coaxially upon the pivot-axis of said ballvalve;

a safety-release means wherein said leverarm is caused to swivel freely upon said pivot-axis until said leverarm is manually urged into positive engagement with a mating indexer on said valve-ball's pivot-shaft, and conversely returning to otherwise free swiveling condition when not so urged;

a combination critical arrangement means by which said handle and proximal said flow-control means facilitate simultaneous single-handed lifting and finger-tip variable pouring therefrom.

17. The safety-canister apparatus according to claim 16, wherein said ballvalve is arranged within said pour-spout cap portion which is screw-threadedly adapted to said canister outlet and includes a short male-spout like outward extension portion capable of receiving a quick-disconnect female-fitting having a nozzle portion, said female-fitting including an annular-flange portion whereby said female-fitting can be removed and inverted 180-degrees for compactly stowing said nozzle portion within said canister confines by unscrewing said pour-spout and reversing the annular-flange of said male-spout between said outlet aperture and said pour-spout cap member.

18. The safety-canister apparatus according to claim 16, wherein said quick-release means is provided by a matched slightly tapered fitting joint arranged between said male-spout and said female-fitting; thereby enabling said male-spout and female-fitting to be manually pressed intimately together, creating a fluid-tight connection until manually urged apart.

19. A child-resistant/tipover-safe flammable-liquid safety-canister apparatus providing convenient ergonomic hand-portable operation; said apparatus comprising:

an imperforate blow-molded polyethylene-plastic container unit, including a handle portion and an inlet and outlet aperture portion;

a pour-spout including a ballvalve therein with a valve-ball having an occludeable through-hole and having selectively variable flow-control means;

a flow-control leverarm arranged upon a pivot-shaft of said valve-ball, said pivot-shaft arranged horizontally transverse to said canister handle longitudinal plane, an aftward biasing of said leverarm thereby opening said ballvalve in line with said pour-spout;

and wherein said ballvalve is made within said pour-spout member which is screw-threadedly adapted to said canister outlet, and includes a short male-spout like outward extension portion mating via quick-disconnect means facilitated by a matched slightly tapered joint to a female-fitting having a nozzle portion, as to be held manually pressed intimately together, creating a fluid-tight connection until manually urged apart, said female-fitting also including an annular-flange to be removed and reverseably reinserted inverted between said outlet aperature and said pour-spout cap for compact stowing of said nozzle portion within said canister confines.

20. The safety-canister apparatus according to claim 19, wherein said nozzle is section of hose made of transparent flexible plastic-tubing, thereby enabling user to visually monitor the flow-rate of liquid pouring from said canister.

* * * * *